United States Patent [19]

Medovar et al.

[11] 4,290,474

[45] Sep. 22, 1981

[54] METHOD AND APPARATUS FOR ELECTROSLAG CASTING OF METALS

[76] Inventors: Boris I. Medovar, ulitsa Anri Barbjusa, 22/26, kv. 109; Georgy A. Boiko, ulitsa Vladimiro-Lybedenskaya, 16, kv. 106; Rudolf S. Dubinsky, ulitsa Politekhnicheskaya, 5, kv. 209; Sergei P. Egorov, ulitsa Nevskaya, 34, kv. 1, all of Kiev, U.S.S.R.

[21] Appl. No.: 47,944

[22] Filed: Jun. 12, 1979

[51] Int. Cl.[3] ..... B22D 27/02

[52] U.S. Cl. ..... 164/470; 164/509

[58] Field of Search ..... 164/52, 252; 13/9 ES; 75/10 C

[56] References Cited

U.S. PATENT DOCUMENTS

| | | | |
|---|---|---|---|
| 3,493,364 | 2/1970 | Nakanishi | 164/52 |
| 3,738,825 | 6/1973 | Medovar et al. | 164/52 |
| 3,783,168 | 1/1974 | Medovar et al. | 13/9 ES |

FOREIGN PATENT DOCUMENTS

| | | | |
|---|---|---|---|
| 51-96735 | 8/1976 | Japan | 164/52 |
| 1413508 | 11/1975 | United Kingdom | 164/52 |

*Primary Examiner*—Robert D. Baldwin
*Assistant Examiner*—K. Y. Lin
*Attorney, Agent, or Firm*—Steinberg & Raskin

[57] ABSTRACT

An apparatus comprises a cooled mould mounted on a bottom plate and at least two consumable electrodes positioned so that their melting ends are at different levels relative to the bottom plate. The electrodes are connected to respective terminals of the secondary winding of a single-phase transformer and the bottom plate is connected to one of these terminals, with the electrode having a melting end at a higher level, being connected to the same terminal as the bottom plate. The electrodes are melted by passing an operating current, first through the electrode with the melting end being at a lower level to the bottom plate and then by passing the operating current from one electrode to the other, respectively, forming a portion of the casting, having a smaller cross-section, and then a portion of the casting, having a larger cross-section.

Thus the present invention is especially well suited for manufacturing workpieces for vital parts such as connecting rods, piston rods, valves for ship engines, etc.

9 Claims, 11 Drawing Figures

METHOD AND APPARATUS FOR ELECTROSLAG CASTING OF METALS

BACKGROUND OF THE INVENTION

The present invention relates to electroslag melting of metals and, particularly, to a method and apparatus for producing castings having one end portion of a larger cross-section, such as workpieces for connecting rods, piston rods, valves of ship engines by electroslag casting of metals.

Most frequently such workpieces are made from steel by forging pressing. With electroslag melting one can produce metals suitable for manufacture of vital parts. These metals have a minimum content of detrimental impurities and a high degree of chemical and physical homogeneity. The electroslag melting is known to be used, at present, for producing a great variety of ingots relatively simple in form. However, attempts to produce shaped castings encounter a number of difficulties.

For producing castings of a variable cross-section by electroslag melting use is made of either one consumable electrode of a variable cross-section or several electrodes having different cross-section, and during the whole melting operation the electrode (electrodes) is melted being connected to the electric power source applying one and the same circuit arrangement which is, as a rule, a single-phase "electrode-bottom plate" circuit. (cf. Latash Yu. V;, Medovar B. I. "Electroslag Remelting," "Metallurgia" Publishers, Moscow, 1970, pp. 125–127/in Russian/).

At present the main types of commercial installations for electroslag melting are single-phase (single-electrode) installations used for casting conversion ingots of square section and ingots of round cross-section for forging.

Certain conventional single-phase apparatus for electroslag casting of ingots are provided with uncompensated power leads having a great length of a circuit comprising an electrode made, in most cases, of magnetic steel and therefore having a high reactance and relatively low operating characteristics and hence low economic factor.

With an increase of the ingot weight and cross-section the electrode cross-section has also to be increased. As a result electroslag melting requires still heavier and heavier current. The reactance of the existing single-phase apparatus considerably increases with the increase of the ingot weight and a cos Y value and the efficiency drop below permissible limits.

In addition, in the existing single-phase apparatus due to the gradual shortening of the consumable electrode, the circuit length and shape considerably change in the process of melting, which brings about a voltage change on the slag pool and changes conditions of the electrode melting and metal solidification, which, in turn, affects the metal quality.

The problem of the efficiency of utilization of the useful electric power has been solved in an apparatus which was disclosed and claimed in the British patent specification, No. 1,117,202 granted to the present applicant. In this apparatus it has been proposed to connect two electrodes in series in a circuit with the secondary winding of the single-phase transformer, which will cause the current to flow from one electrode through the slag pool and partially molten metal to the second electrode. In this electric circuit, which will be called furtheron an "electrode-electrode" circuit, all elements thereof are arranged anti-parallelly at a distance providing for its compensation, like in a bifilar winding of resistors.

In producing castings with a variable cross-section, applying the existing installations for electroslag melting, there arise difficulties in selecting consumable electrodes which would ensure a uniform filling of the mould without reduction of the power factor.

In producing the above castings on the single-phase installations with one (or several) consumable electrodes connected in an "electrode-bottom plate" circuit, in addition to the above difficulties, there arises a necessity to readjust the installation when a part of the mould, having a larger cross-section, is to be filled with metal. For this purposes either several electrodes or one electrode of a large cross-section should be used.

On the other hand, production of castings of said shape on the single-phase installations equipped with at least two electrodes connected in an "electrode-electrode" circuit, in spite of improved economy, presents difficulties in filling with metal a part of the mould, having a smaller cross-section, when the electrodes are arranged to provide for a uniform filling of that portion of the mould, which has a larger cross-section. This is acounted for by the fact that the electrodes are impossible to be introduced into the part of the mould, having a smaller cross-section.

Disclosed in U.S. Pat. No. 3,783,168 and British patent specification No. 1,362,889 is apparatus for the production of castings by electroslag melting of metals, comprising a cooled mould mounted on a bottom plate connected through a switch to one of the two terminals of the electric power source, and at least two consumable electrodes one of which is connected to the same terminal as the bottom plate, and the second electrode being connected to the other terminal of the electric power source. This apparatus provides for the production of a great variety of ingots of a relatively simple form. However attempts to produce shaped castings, and, in particular, castings of the above shape, encounter difficulties mentioned above.

SUMMARY OF THE INVENTION

It is an object of this invention to provide a method for producing castings having one end portion of a larger cross-section by electroslag casting of metals, permitting a quality of the castings to be improved due to a uniform filling of the mould with a molten metal.

Another object of the present invention is to provide a method for producing castings of the above type, permitting automatic change-over from one operation to another.

A further object of the present invention is to provide an economical method for the production of castings of the above type.

Still another object of the present invention is to provide an apparatus for producing castings having one end of a larger cross-section by electroslag casting of metals.

These and other objects of the invention are attained by a method for producing castings having one end portion of a larger cross-section by electroslag casting of metals in a mould of a desired shape mounted on a bottom plate connected to one of the two terminals of an electric power source, with melting of at least two consumable electrodes each connected to a respective terminal of the same electric power source, wherein, in accordance with the invention, first a casting portion of smaller cross-section is formed by melting down a consumable electrode connected to the electric power source in series with the bottom plate and then a casting portion of a larger cross-section is formed by simultaneously melting down both electrodes connected in series to the same electric power source.

Such succession of melting down the electrodes and deposition of metal in the mould permits the castings of said type to be formed continuously. In other words, melting-down of one of the electrodes connected in an "electrode-bottom plate" circuit, followed by melting-down of at least two electrodes connected in an "electrode-electrode" circuit, provides for melting of at least one electrode in the narrow, i.e. smaller part of the mould, and a plurality of electrodes in the larger part of mould, thus ensuring a uniform filling thereof.

Automatic change-over from moulding the casting portion of a smaller cross-section to moulding the casting portion of a larger cross-section can be effected by arranging the electrodes so that at least one of them is introduced in the narrow part of the mould and at least one another is disposed at such a level that after moulding of the casting portion in the narrow part of the mould, it will close the electric circuit including these electrodes and said electric power source. In this case the circuit is closed through the slag pool, and all the electrodes connected in an "electrode-electrode" circuit are melted simultaneously.

A method for producing castings having one end portion of a larger cross-section by electroslag casting of metals can be carried out with the aid of an apparatus comprising a cooled mould mounted on a bottom plate connected through a switch to one of the two terminals of an electric power source, and at least two consumable electrodes one of which is connected to the same terminal as the bottom plate, with the other electrode being connected to the other terminal of the same electric power source, wherein, in accordance with the invention, the electrodes mounted so that their melting ends are different levels relative to the bottom plate, at the higher level being the melting end of that electrode which is connected to the same terminal of the electric power source as the bottom plate.

In accordance with the invention an apparatus is provided to carry out the method for producing castings having one end portion of larger cross-section by electroslag casting of metals, ensuring a uniform filling-in of the mould, a high quality of the castings and a lower consumption of the electric energy as compared to the apparatus wherein an electrode (electrodes) is connected in an "electrode-bottom plate" circuit.

The invention can well be embodied with the same effect if the electrodes are made different in length and are mounted fixedly relative to each other, or equal in length and are movably mounted relative to each other.

The consumable electrode the melting end of which is located lower than that of the other electrode, is movably mounted relative to the bottom plate. In addition, the electrode may either be of a variable cross-section or be composed of two coaxially non-aligned parts.

BRIEF DESCRIPTION OF THE DRAWINGS

Other objects, advantages and features of the present invention will be readily apparent from the following detailed description relating to the annexed drawings, in which.

DESCRIPTION OF THE PREFERRED EMBODIMENTS

Figure 1:
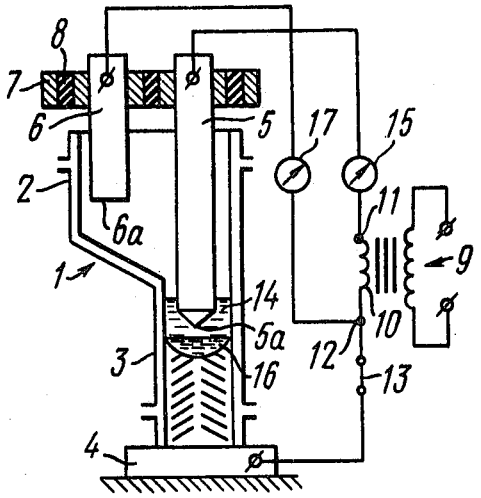
FIG. 1 is a diagrammatic representation of an apparatus embodying the present invention, with one of the electrodes connected in an "electrode-bottom plate" circuit.
Figure 2:
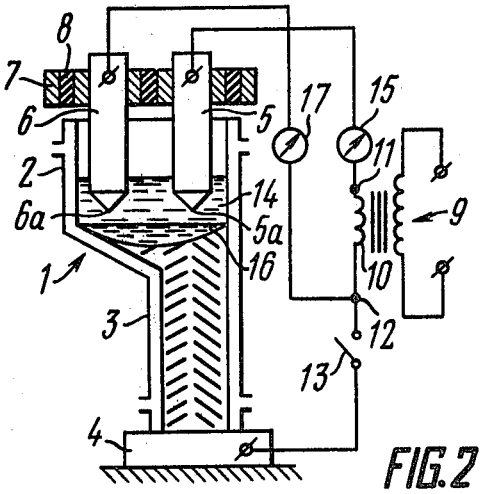
FIG. 2 is a diagrammatic representation of the apparatus of FIG. 1, with the electrodes connected in an "electrode-electrode" circuit.
Figure 3:
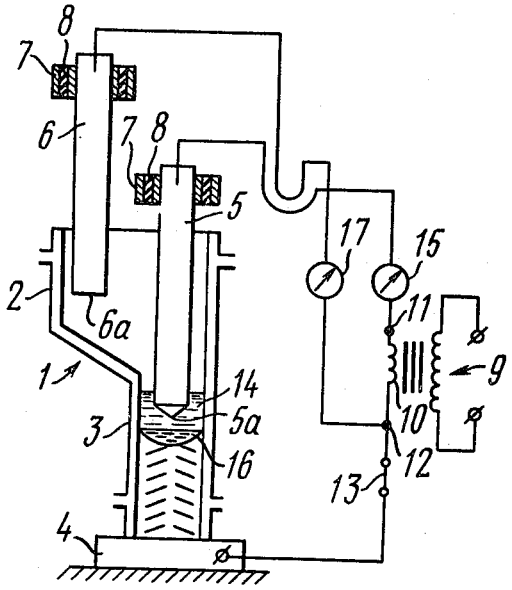
FIG. 3 is a diagrammatic representation of the apparatus comprising electrodes movably mounted relative to each other according to the invention.

FIGS. 1–3 diagrammatically illustrate an apparatus for producing castings having one end portion of a larger cross-section, such as workpieces for connecting rods for ship engines, by electroslag casting of metals in accordance with the invention.

This apparatus comprises a cooled mould 1 of a desired shape, as shown in FIGS. 1 and 2, having a portion 2 of a larger cross-section and a portion 3 of a smaller cross-section. The mould 1 of an open-ended construction is mounted on a bottom plate 4 and can be either non-movable, as shown in FIGS. 1 and 2, or movable, as shown in FIG. 3. Secured above the mould 1 and partially introduced therein are at least two consumable electrodes, namely, a first consumable electrode 5 and a second consumable electrode 6. The number of electrodes may be greater depending on the cross-section area of the mould and that of the electrodes, which is determined by the known relationship between dimensions of the mould and those of the electrodes. The electrodes 5 and 6 are fixed in an electrode holder 7 and insulated from each other by insulating gaskets 8.

The electrodes 5 and 6 are supplied with electric power from an electric power source, such as a single-phase transformer 9. The electrode 5 is connected in the circuit of a secondary winding 10 of the transformer 9, i.e. to one of the secondary winding terminals designated with a reference numeral 11 and the second electrode 6 is connected in the circuit of the secondary winding 10 through the other terminal thereof designated with a reference numeral 12. To effect closing the electric circuit during operation the bottom plate 4 is connected with the terminal 12 through a switch 13. The switch 13 may be of any suitable design. Here we may refer to U.S. Pat. No. 3,783,168 wherein a change-over switch is disclosed which is suitable to accomplish the aims of the present invention.

Thus in the apparatus, in accordance with the invention, two electric circuits are formed, wherein in one case the first and the second electrodes 5 and 6, respectively, are connected in a circuit "electrode-electrode," and in the other case the first electrode 5 is connected in a circuit "electrode-bottom plate."

In accordance with the invention the first consumable electrode 5 and the second consumable electrode 6 are mounted so that their melting ends 5*a* and 6*a* are at two different levels relative to the bottom plate 4, and namely, the melting end 5*a* is positioned at a first level while the melting end 6*a* is positioned at a second level. As can be seen in FIG. 1 the electrode 5 is longer than the electrode 6 and its melting end 5*a* is located lower than the melting end 6*a* of the electrode 6.

As the second consumable electrode 6 is another than the first consumable electrode 5, the length and cross-section of said electrodes as well as their numbers are determined taking into consideration the mould size.

In so far as the diagrammatic representation of the above apparatus, in accordance with the invention, as shown in the drawings, comprises only those structural elements which are necessary for illustrating the nature of the invention, it will become apparent to those skilled in the art that for practical embodiment of the invention additional means are needed such as a system for supply and discharge of water or some other medium suitable for cooling the mould and the bottom plate, a system for sucking off the gases evolving during the metal melting, a system for controlling the production process and other equipment which, because of their being well known, are not shown in the drawings and not described in detail.

The method, in accordance with the invention, will be illustrated by way of example showing operation of the apparatus for electroslag casting of metals in a mould to produce castings having one end portion of a larger cross-section.

Melting of the electrodes 5 and 6 is started after formation of slag pool 14 in the mould 1 by way of the known in the art methods, for example, by filling the mould with a preliminarily molten slag. This being the case, the first consumable electrode 5 is melted. As the first consumable electrode 5 melts a portion of the casting is formed in the part 3 of the mould 1, having a smaller cross-section, i.e. in a narrower part of the mould 1. At this time the first consumable electrode 5 is connected in series in a circuit including a recording instrument, say an ammeter 15, the secondary winding 10 of the single-phase transformer 9, the switch 13 and the bottom plate 4. During formation of the casting in the part 3 of the mould 1, the current flows through the body of the casting, a molten metal 16 and the slag pool 14; the first consumable electrode being connected in a circuit "electrode-bottom plate". Electrode feeding is adjusted by the current flowing through the first consumable electrode 5 and measured by the ammeter 15.

When moulding of the casting in the narrower part of the mould 1 is finished and, as a result, the larger part 2 is filled with the slag pool 14, the second consumable electrode 6 with the melting end 6*a* will immerse in the slag pool 14 thereby causing the current to flow in a circuit now including the secondary winding 10, a recording instrument, such as an ammeter 17, the second consumable electrode 6 and the first consumable electrode 5. As the second consumable electrode 6, dips into the slag pool, the current measured by the ammeter 17 increases, and as soon at it reaches a value equal to a half of the total operating current, the switch 13 deenergizes the bottom plate 4 thereby initiating melting of the electrodes in a wider part 2.

Figure 4:
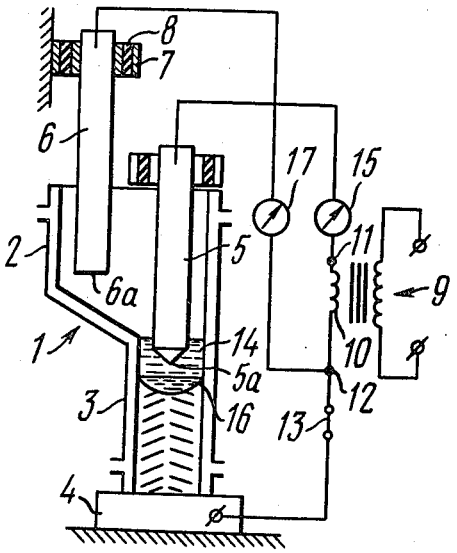
FIG. 4 is a diagrammatic representation of the apparatus comprising one electrode movably mounted relative to the bottom plate according to the invention.

According to the concept of the invention the first consumable electrode 5 and the second consumable electrode 6 may be equal in length movably in which case they are mounted relative to each other and are secured in separated electrode holders 18 and 19 in such a manner that their melting ends 5*a* and 6*a* are positioned at different levels (FIG. 3). This condition will be also satisfied if the first consumable electrode 5 is movably mounted relative to the bottom plate 4, with the second consumable electrode 6 being mounted fixedly (FIG. 4). In this case the second consumable electrode 6 may be fixedly secured on the mould 1.

Figure 5:
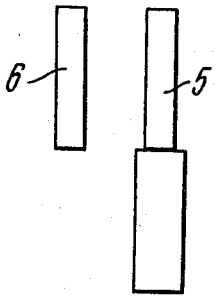
FIG. 5 is a diagrammatic representation of the electrodes one of which is of a variable cross-section according to the invention.
Figure 6:
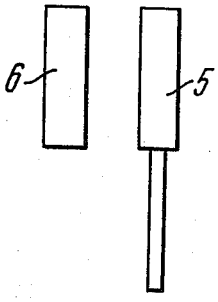
FIG. 6 is a diagrammatic representation of the electrodes one of which is of a variable cross-section according to another embodiment of the invention.

Referring to FIGS. 5 and 6, one of the electrodes, for example, the first consumable electrode 5, may have a variable cross-section. Such electrode maybe of an integral construction of variable cross-section, or may be welded of several parts of different cross-section.

Figure 7:
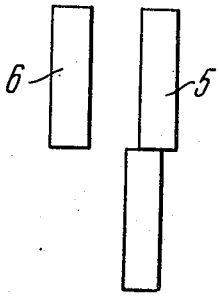
FIG. 7 is a diagrammatic representation of the electrodes one of which includes two coaxially non-aligned parts.

Furthermore, one of the electrodes may include two coaxially non-aligned parts (FIG. 7).

Figure 8:
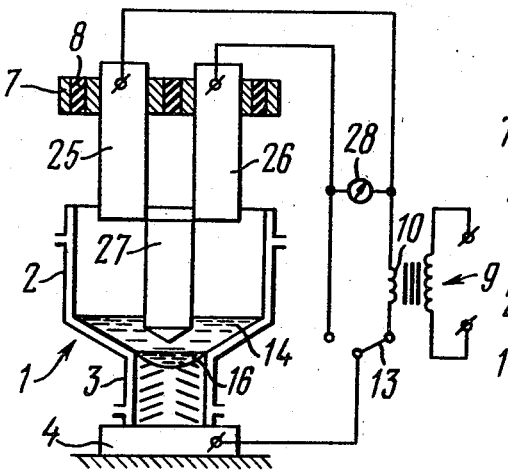
FIG. 8 is a diagrammatic representation of the apparatus with the electrodes connected in parallel and in series, first operation step according to the invention.
Figure 9:
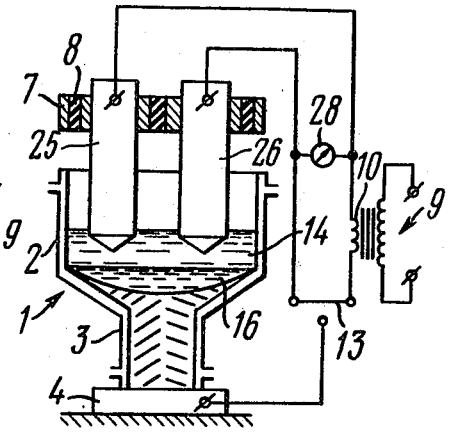
FIG. 9 is similar to FIG. 8, second operation step.

As can be seen in FIGS. 8 and 9, the apparatus, in accordance with the invention, may comprises at least three consumable electrodes 25, 26 and 27. Depending on the turn-on sequence, the electrodes 25, 26 and 27 can be connected in series and in parallel, i.e. the electrodes 25 and 26 are connected in parallel in the "electrode-bottom plate" circuit, and in series in the "electrode-electrode" circuit. In both cases, the electrode 27 is used to connect the electrodes 25 and 26.

In operation the consumable electrode 27 is melted being connected in the circuit "electrode-bottom plate." When the consumable electrode 27 is completely melted down, an instrument 28 for measuring resistance between melting ends or between upper ends of the electrodes 25 and 26 will record an increase of said resistance. This increase of the resistance occurs as a result of the instrument 28 circuit being closed through the slag pool 14 whose resistance is considerably higher than that of the molten metal 16. The switch 13 will disconnect the terminal 12 from the bottom plate 4 and will connect it to the consumable electrode 25. Henceforth the electrodes will be melted being connected in the "electrode-electrode" circuit (FIG. 9).

Figure 10:
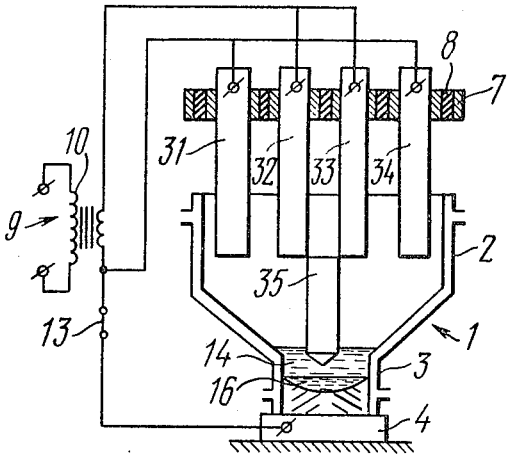
FIG. 10 is a diagrammatic representation of the apparatus, with the electrodes connected in parallel and in series, first operation step, according to the invention.
Figure 11:
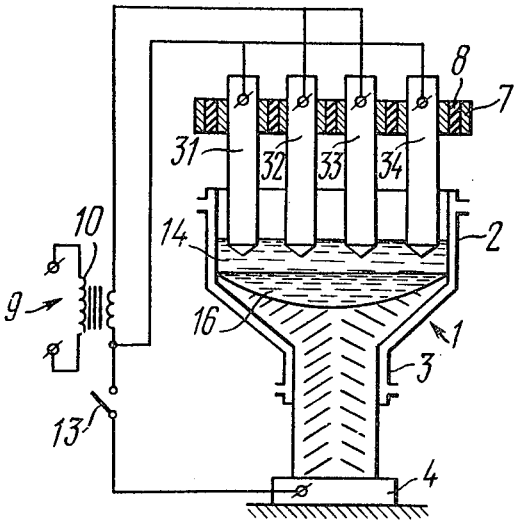
FIG. 11 is similar to FIG. 10, second operation step.

Another embodiment of the invention is illustrated in FIGS. 10 and 11. According to this embodiment, the apparatus comprises at least five consumable electrodes 31,32,33,34 and 35. The consumable electrodes 31 and 34 are connected in parallel in the "electrode-electrode" circuit including the consumable electrodes 32 and 33 which are also connected in the electric circuit in parallel. The consumable electrode 35 is connected to the consumable electrodes 32 and 33 to form the "electrode-bottom plate" circuit.

In the course of melting operation when the portion of the casting, having a smaller cross-section, is formed the current flows through the electrodes 32,33 and 35 and further through the bottom plate 4. As soon as the consumable electrodes 35 is melted down, the electrodes will be connected in the "electrode-electrode" circuit, i.e. the current will flow between the consumable electrodes 31 and 32, 33 and 34, with the bottom plate 4 being de-energized (FIG. 11).

The above apparatus provides for the production of castings of the above the number and shape of electrodes being selected arbitrarily with due account for the circuit arrangement and operation procedure as described in the appended claims.

While the invention has been described herein with reference to the accompanying drawings, various changes in the shape, size and auxiliary equipment may be resorted to, without departing from the invention as set forth in the appended claims.

We claim:

1. A method for producing castings having one end portion of a larger cross-section by electroslag casting of metals in a mould of a desired shape, mounted on a bottom plate, which method comprises the steps of: forming a portion of the casting, having a smaller cross-section, by melting at least one first consumable electrode connected to one terminal of an electric power source in series with said bottom plate connected to the other terminal of said electric power source, and forming a portion of the casting, having a larger cross-section, by simultaneously melting at least one first consumable electrode and at least one second consumable electrode, said first and second electrodes being connected in series with said electric power source.

2. A method as claimed in claim 1, wherein the step of forming the smaller cross-section casting portion is initiated by the step of introducing the first consumable electrode into the mould to a position wherein it is in contact with the slag pool surface so as to close the electric circuit and start the melting of a melting end of said first electrode, and wherein the step of forming the larger cross-section casting portion includes the step of positioning the second consumable electrode at a location wherein after the portion of the casting having a smaller cross-section is formed, the second electrode will close the electric circuit comprising said first consumable electrode and said electric power source connected in series.

3. A method as claimed in claim 1 including positioning the second consumable electrode so that after formation of the smaller cross-section casting portion is completed, the second electrode contacts the slag pool to close a series circuit including the first consumable electrode and a source of electric power and wherein the step of forming the larger cross-section casting portion includes the step of melting the second consumable electrode simultaneously with the first consumable electrode.

4. An apparatus for producing castings having one end portion of a larger cross-section, by electroslag casting of metals, comprising: a cooled mould, a bottom plate of said mould, an electric power source having two terminals, a switch connecting said bottom plate to one of the terminals of said electric power source, at least one first consumable electrode with a melting end located at a first level relative to said bottom plate, said first consumable electrode being connected to the other terminal of said electric power source, at least one second consumable electrode with a melting end positioned at a second level relative to said bottom plate, said second consumable electrode being connected to the same terminal of said electric power source as said bottom plate, said second level being higher than said first level.

5. An apparatus as claimed in claim 4, wherein said first and said second consumable electrodes are of different length, and are fixedly mounted relative to each other.

6. An apparatus as claimed in claim 4, wherein said first and said second consumable electrodes are equal in length, and are movably mounted relative to each other.

7. An apparatus as claimed in claim 4, wherein said first consumable electrode is movably mounted relative to said bottom plate.

8. An apparatus as claimed in claim 4, wherein said first consumable electrode is of a variable cross-section.

9. An apparatus as claimed in claim 4, wherein said first consumable electrode includes two coaxially non-aligned parts.

* * * * *